US008646708B2

(12) United States Patent
Halla

(10) Patent No.: US 8,646,708 B2
(45) Date of Patent: Feb. 11, 2014

(54) REFINER WITH FLOW GUIDE INSIDE ROTOR OR STATOR

(75) Inventor: Jorma Halla, Valkeakoski (FI)

(73) Assignee: Metso Paper, Inc., Helsinki (FI)

( * ) Notice: Subject to any disclaimer, the term of this patent is extended or adjusted under 35 U.S.C. 154(b) by 40 days.

(21) Appl. No.: 13/381,973

(22) PCT Filed: Jul. 1, 2010

(86) PCT No.: PCT/FI2010/050570

§ 371 (c)(1),
(2), (4) Date: Jan. 2, 2012

(87) PCT Pub. No.: WO2011/001034

PCT Pub. Date: Jan. 6, 2011

(65) Prior Publication Data

US 2012/0104132 A1 May 3, 2012

(30) Foreign Application Priority Data

Jul. 3, 2009 (FI) ..... 20090267

(51) Int. Cl.
*D21D 1/00* (2006.01)

(52) U.S. Cl.
USPC ..... 241/84; 241/86; 241/89.3; 241/95

(58) Field of Classification Search
USPC ..... 241/84–86, 89.3, 95
See application file for complete search history.

(56) References Cited

U.S. PATENT DOCUMENTS

| | | | | |
|---|---|---|---|---|
| 2,660,934 | A | 12/1953 | Laviste | |
| 2,679,788 | A | 6/1954 | Skardal | |
| 2,741,954 | A | 4/1956 | Allibe | |
| 4,819,881 | A * | 4/1989 | Sepke | 241/88.1 |
| 4,955,549 | A * | 9/1990 | Reinhall | 241/80 |
| 5,326,038 | A * | 7/1994 | Nilsson | 241/74 |
| 2003/0213860 | A1 * | 11/2003 | Pilao | 241/261.1 |

FOREIGN PATENT DOCUMENTS

| | | |
|---|---|---|
| DE | 863898 | 1/1953 |
| DE | 1009912 | 6/1957 |
| DE | 102004039986 A1 | 12/2007 |
| WO | 2011001034 A1 | 1/2011 |

OTHER PUBLICATIONS

International Search Report for PCT/FI2010/050570.
Written Opinion of the International Searching Authority for PCT/FI2010/050570.

* cited by examiner

*Primary Examiner* — Dana Ross
*Assistant Examiner* — Leonel Vasquez
(74) *Attorney, Agent, or Firm* — Stiennon & Stiennon

(57) ABSTRACT

A refiner (1) for refining fibrous material has a first refiner element (3, 5) and a second refiner element (3, 5). The second refiner element is arranged around the first refiner element in such a manner that the first refiner element and the second refiner element have a common middle axis (7) such that there is a refining space (8) between the first refiner element and the second refiner element. The first refiner element and/or the second refiner element are arranged to rotate around the middle axis and the refiner elements have refining surfaces (4, 6), through which the fibrous material is fed into or exits the refining space (8). The refiner has, in the direction of the middle axis of the refiner elements, at least two feed regions, through which the fibrous material to be refined is feedable into the refining space (8).

15 Claims, 3 Drawing Sheets

REFINER WITH FLOW GUIDE INSIDE ROTOR OR STATOR

CROSS REFERENCES TO RELATED APPLICATIONS

This application is a U.S. national stage application of International App. No. PCT/FI2010/050570, filed Jul. 1, 2010, the disclosure of which is incorporated by reference herein, and claims priority on Finnish App. No. 20090267, Jul. 3, 2009, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a refiner for refining fibrous material, the refiner comprising at least one first refiner element and at least one second refiner element, the second refiner element being arranged around the first refiner element in such a manner that the first refiner element and the second refiner element have a common middle axis and that there is a refining space between the first refiner element and the second refiner element and that the first refiner element and/or the second refiner element are arranged to rotate around said middle axis and that the refiner elements comprise refining surfaces with openings, through which the fibrous material to be refined is fed into the refining space or through which the refined fibrous material exits the refining space.

Refiners for treating fibrous material typically comprise two, possibly even more refiner elements substantially opposite to one another, between which there is a refining space or refiner gap to which the fibrous material to be refined is fed. At least one of the refiner elements is arranged to move with respect to the opposite refiner element. The movable refiner element which typically rotates around its axis may also be called the rotor, and the fixed refiner element may also be called the stator. The refiner elements comprise the refining surfaces that carry out the actual refining, whereby the refining surfaces may be one integral structure or they may consist of a plurality of refining surface segments or blade segments arranged adjacent to one another, the refining surfaces of individual refining surface segments forming one uniform refining surface.

The refining space is a space which is formed between the refining surfaces of the rotor and the stator and where the refining takes place. The refining is caused by mutual pressing and motion of the refining surfaces as a result of frictional forces between the refining surfaces and the material to be refined and, on the other hand, due to frictional forces inside the material to be refined. The surface area between the refining surfaces of the rotor and the stator is the refining area, by which the refining between the refining surfaces of the rotor and the stator takes place in the refining space. The shortest distance between the refining surfaces of the rotor and the stator in the region of the refining area is the blade gap.

To increase the production of refiners, it is important to guide the fibrous material to be refined efficiently between the opposite refining surfaces. At the same time, it is naturally important to enable the removal of sufficiently refined material from between the refining surfaces in such a manner that the refined material does not block up the refining space between the refining surfaces and thus weaken the production of the refiner. For instance the refining surfaces, which comprise blade bars and blade grooves in such a manner that the fibrous material is refined between the blade bars of the opposite refining surfaces and both the material to be refined and the already refined material are able to move in the blade grooves between the blade bars on the refining surface, may have special dams on the bottom of the blade grooves. The dams force the material being refined to move away from the bottom of the grooves and on between the opposite refining surfaces. However, the effect of the dams is local and does not substantially benefit the whole area of the refining surface. The dams also diminish the hydraulic capacity of the refining surface considerably.

Publication EP 0597860 B1 discloses a refiner comprising a substantially cylindrical movable refiner element, i.e. a rotor, and stator shoes, i.e. fixed refiner elements, against it, the stator shoes together providing the fixed refining surface for the refiner. Depending on the embodiment of the publication, the fixed refining surface of the refiner is located on the side of either the inner periphery or the outer periphery of the rotor and extends along a part of the rotor in the circumferential direction. Both the rotor and the stator shoes comprise perforations extending through them so that the fibrous material to be refined may be fed via the perforations in the rotor in between the rotor and the stator shoes and that the refined fibrous material may exit from between the rotor and the stator shoes via the perforations in the stator shoes. The refiner according to the publication also comprises special flow guide means, by which fibrous material to be refined is fed in the circumferential direction of the rotor in such a manner that material is fed to the front part of the stator shoes in the rotational direction of the rotor. Through the perforations extending through both the rotor and the stator shoes, it is possible to feed material to be refined in between the rotor and the stator shoes and to remove the refined material quite efficiently therefrom. However, the efficiency of feed of material to be refined in the refiner of the publication is restricted by the fact that material to be refined is fed to a very small area, i.e. only to the front part of the stator shoes.

SUMMARY OF THE INVENTION

It is an object of the present invention to provide a new type of solution for feeding fibrous material to be refined into a refining space of a refiner.

The refiner of the invention is characterized in that the refiner comprises at least one support structure, a wall structure, a flow guide, a channel or a channel system for dividing the refiner in the direction of the middle axis of its refiner elements into at least two feed regions, through which the fibrous material to be refined is feedable into the refining space.

The refiner for refining fibrous material comprises at least one first refiner element and at least one second refiner element, the second refiner element being arranged around the first refiner element in such a manner that the first refiner element and the second refiner element have a common middle axis and that there is a refining space between the first refiner element and the second refiner element. The first refiner element and/or the second refiner element is/are further arranged to rotate around said middle axis. The refiner elements further comprise refining surfaces with openings, through which the fibrous material to be refined is fed into the refining space or through which the refined fibrous material exits the refining space. The refiner further comprises at least one support structure, a wall structure, a flow guide, a channel or a channel system for dividing the refiner in the direction of the middle axis of its refiner elements into at least two feed regions, through which the fibrous material to be refined is feedable into the refining space.

As the refiner comprises in the direction of the middle axis of the refiner elements at least two feed regions, through which fibrous material to be refined may be fed into the refining space of the refiner, a different amount or quality of material to be refined can be fed in different feed regions into the refining space of the refiner. Alternatively, it is possible to feed the same amount and quality of material to be refined through different feed regions, in which case it is easier to achieve a steady feed of material to be refined over the entire length of the refining space.

BRIEF DESCRIPTION OF THE DRAWINGS

Some embodiments of the invention will be described in more detail in the attached drawings.

DESCRIPTION OF THE PREFERRED EMBODIMENTS

In the figures, some embodiments of the invention are shown simplified for the sake of clarity. Similar parts are marked with the same reference numbers in the figures.

Figure 1:
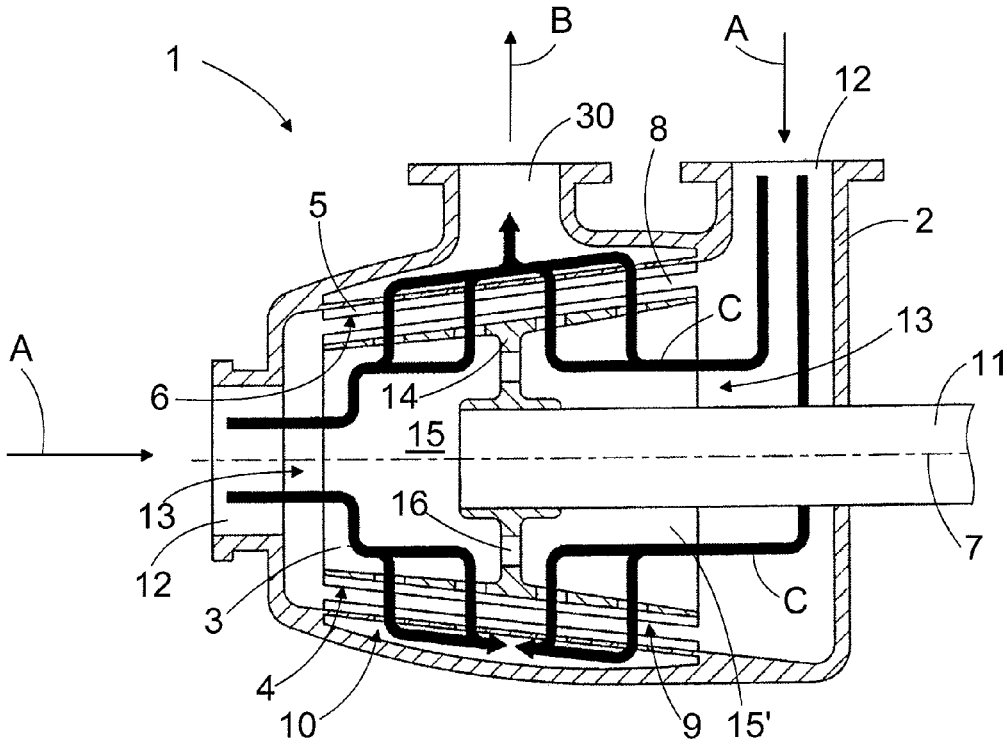
FIG. 1 schematically shows a side view of a cone refiner in cross-section.

FIG. 1 schematically shows a side view of a refiner 1 with a frame 2 in cross-section. The refiner of FIG. 1 is a cone refiner and comprises a conical rotating refiner element 3, i.e. a rotor 3, which is arranged inside the refiner frame 2, has a substantially hollow inner side or inner part and is provided with a conical refining surface 4. The refiner 1 further comprises a conical fixed refiner element 5, i.e. a stator 5, which is provided with a conical refining surface 6. In the embodiment of FIG. 1, the stator 5 is fixed directly to the frame 2 of the refiner 1 and the rotor 3 is arranged inside the stator 5 so that the rotor 3 forms the first refiner element of the refiner 1 according to FIG. 1 and the stator 5 forms the second refiner element of the refiner 1 according to FIG. 1, the refiner elements having a common middle axis 7 and a conical refining space 8 between them. The refining surface 4 of the rotor 3 comprises openings 9, through which fibrous material to be refined can be fed into the refining space 8, and the refining surface 6 of the stator 5 comprises openings 10, through which the fibrous material refined in the refining space 8 may exit the refining space 8. The refiner 1 of FIG. 1 also comprises a shaft 11 of the refiner 1, via which the rotor 3 of the refiner 1 may be rotated around the middle axis 7 common to the rotor 3 and the stator 5 by means of a motor not shown for the sake of clarity.

The frame 2 of the refiner 1 of FIG. 1 comprises two feed connections 12, through which fibrous material to be refined may be fed into the refiner 1, as shown by arrows A. At both ends of the rotor 3 there are feed openings 13, through which fibrous material to be refined may be fed into the rotor 3 of the refiner 1. The material to be refined moves through the openings 9 in the refining surface 4 of the rotor 3 into the refining space 8 between the refining surface 4 of the rotor 3 and the refining surface 6 of the stator 5, where it is refined. The refined fibrous material exits the refining space 8 through the openings 10 in the refining surface 6 of the stator 5 and further out of the refiner 1 via a discharge connection 30 at the frame 2, as shown by arrow B. Arrows C drawn inside the refiner 1 with a thick line illustrate the flow of material to be refined in the refiner 1 schematically.

In the rotor 3 of the refiner 1 according to FIG. 1, there are at both, i.e. opposite, ends of the rotor 3 feed openings 13 for feeding the material to be refined into the rotor 3. In the refiner 1 of FIG. 1, the rotor 3 thus comprises at least two feed openings 13, which are arranged, viewed in the direction of the middle axis 7 of the refiner elements, at the opposite ends of the rotor 3 in order to feed fibrous material to be refined into the rotor 3 and further via or through the openings 9 in the refining surface 4 of the rotor 3 to the refining space 8. In the embodiment of FIG. 1, the inner space of the rotor 3 is divided by a support structure 14 into two parts 15 and 15', which are in connection with one another by means of connection openings 16, whereby material to be fed to the rotor 3 may move via the connection openings 16 from one side of the support structure 14 to the other, whereupon materials arriving at said parts 15 and 15' may mix with one another, which may be advantageous for the refining result, if the properties or feed rates of the materials to be refined that come via the feed connections 12 differ from one another, for example. It is also possible to have an embodiment, in which the support structure 14 does not have any connection openings 16 and the inner parts of the rotor 3 are entirely separate from one another, whereby material to be refined may be fed as separate feed flows which possibly have differing properties and particularly the volume flows of which may be adjusted separately.

Due to the feed openings 13 arranged, viewed in the direction of the middle axis 7 of the refiner elements 1, at both, i.e. opposite, ends of the rotor 3, material to be refined can be fed efficiently and steadily into the rotor 3 and further to the refining space 8, thus achieving a high production of the refiner and a uniform quality of the refined material. Such a structure provides a simple and cost-efficient structural solution for axially feeding two materials to be refined, which are separate from one another or have different quantities or qualities, to the parts 15, 15' inside the rotor of the refiner, i.e. the feed spaces 15, 15', or the feed regions 15, 15'.

In the embodiment of FIG. 1, the feed openings 13 arranged at the opposite ends of the rotor 3 in the direction of the middle axis 7 of the refiner elements are thus applied to a situation in which the refiner rotor is arranged inside the refiner stator, but the solution could also be employed in a refiner where the refiner stator is arranged inside the refiner rotor 3, in which case the refiner stator would form the first refiner element and the refiner rotor the second refiner element.

Further in the embodiment of FIG. 1, the feed openings 13 arranged at the opposite ends of the rotor 3 when viewed in the direction of the middle axis 7 of the refiner are thus applied to a cone refiner, but all of the above may also be applied to cylindrical refiners, in which both the rotating refiner element, i.e. the rotor, as well as its refining surface and the fixed refiner element, i.e. the stator, as well as its refining surface are cylindrical, in which case the refining space between the rotor and the stator is cylindrical.

The refining surface of the stator or rotor of the refiner may be one integral structure or it may consist of a plurality of refining surface segments arranged adjacent to one another, whereby the refining surfaces of individual refining surface segments form one uniform refining surface. The refining surfaces may comprise specific blade bars, i.e. bars, and blade grooves, i.e. grooves, therebetween, fibrous material being refined between the blade bars of the opposite refining surfaces and both the material to be refined and the already refined material being able to move in the blade grooves between the blade bars on the refining surface. On the other hand, the refining surface may comprise protrusions and recesses between the protrusions. The blade bars and blade grooves of the refining surfaces, or the protrusions and recesses of the refining surfaces, may be made of the basic material of the refiner blade or a separate material. The protrusions may be formed, for example, of ceramic grits attached to the refining surface by previously known methods. The refining surfaces, i.e. the blade surfaces, may also be formed of separate lamellae arranged adjacent to or at a distance from one another and fixed to form a refining surface. The refining surface may also comprise a large number of small protrusions and recesses therebetween, in which case the refiner operates by a grinding principle.

Figure 2:
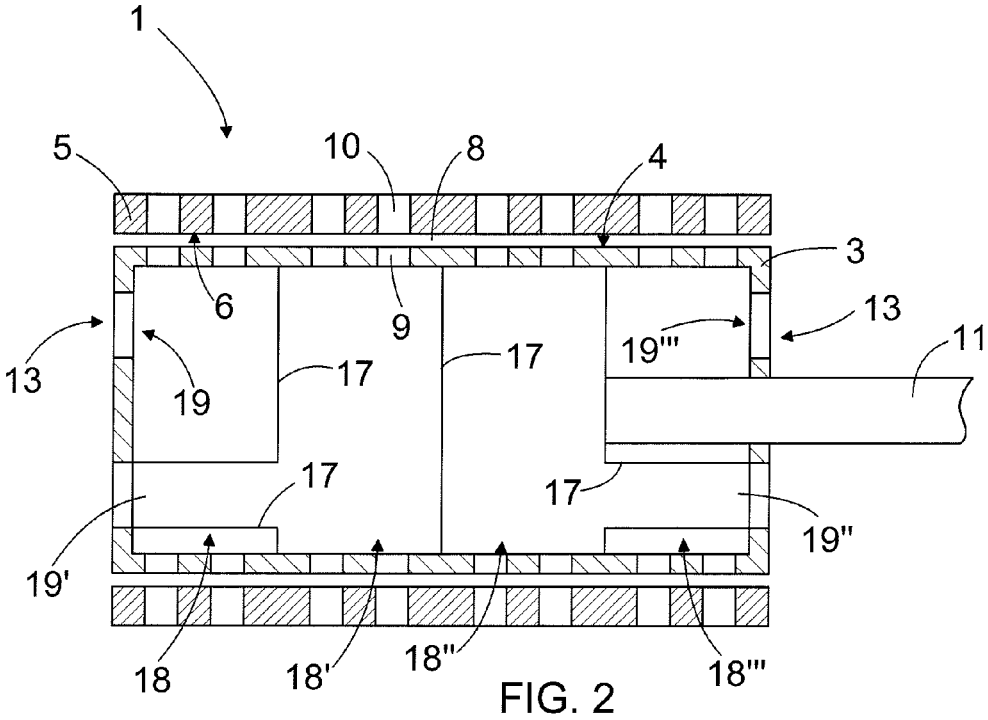
FIG. 2 schematically shows a side view of a cylindrical refiner in cross-section.

FIG. 2 very schematically and by way of example shows a side view of a second refiner 1 in cross-section. The refiner of FIG. 2 is a cylindrical refiner and comprises a cylindrical refiner element 3, i.e. a rotor 3, which is rotated by a shaft 11 and provided with a cylindrical refining surface 4, and a cylindrical fixed refiner element 5, i.e. a stator 5, which is provided with a cylindrical refining surface 6. For the sake of clarity, a motor rotating the shaft 11 is not shown in FIG. 2. In the embodiment of FIG. 2, the rotor 3 is arranged inside the stator 5 so that the rotor 3 forms the first refiner element of the refiner and the stator 5 forms the second refiner element of the refiner, and they have a common middle axis extending along the middle part of the shaft 11 of the refiner 1. The refining surface 4 of the rotor 3 and the refining surface 6 of the stator 5 are arranged at a distance from one another so that a cylindrical refining space 8 is formed between them. The refining surface 4 of the rotor 3 comprises openings 9, through which fibrous material to be refined is fed into the refining space 8, and the refining surface 6 of the stator 5 comprises openings 10, through which the fibrous material refined in the refining space 8 exits the refining space 8.

At both, i.e. opposite, ends of the rotor 3 of the refiner 1 according to FIG. 2 there are feed openings 13 of the rotor 3, through which fibrous material to be refined may be fed into the rotor 3 of the refiner 1. The material to be refined moves through the openings 9 in the refining surface 4 of the rotor 3 into the refining space 8, where it is refined. The refined fibrous material exits the refining space 8 through the openings 10 in the refining surface 6 of the stator 5 and leaves the refiner 1.

The rotor 3 of the refiner 1 according to FIG. 2 thus comprises at both, i.e. opposite, ends of the rotor 3 feed openings 13 for feeding material to be refined into the rotor 3. In the refiner 1 of FIG. 2, the rotor 3 thus comprises at least two feed openings 13, which are arranged, viewed in the direction of the middle axis of the refiner elements, at the opposite ends of the rotor 3 in order to feed the fibrous material to be refined into the rotor 3 and further via or through the openings 9 in the refining surface 4 of the rotor 3 into the refining space 8.

The refiner according to FIG. 2 further comprises partition wall structures 17 inside the rotor 3, which divide the space inside the refiner rotor 3, at least on the circumference of the rotor 3 in the direction of the middle axis of the refiner elements, into separate feed regions generally marked with reference numeral 18, in FIG. 2 four feed regions 18, 18', 18", 18''', and into separate feed channels inside the rotor, generally marked with reference numeral 19, in such a manner that each feed channel 19, 19', 19", 19''' guides material to be refined to a specific, corresponding feed region 18, 18', 18", 18'''. In practice, the feed openings 13 at the top of FIG. 2 correspond to the feed channels 19, 19''', which guide material fed to the rotor 3 and then to be refined to the feed regions 18 and 18''' closest to the ends of the rotor 3. By guiding the same amount of material to be refined via each feed channel 19, 19', 19", 19''' to each feed region 18, 18', 18", 18''', it is possible to ensure a steady feed of material to be refined in the entire refining space in the direction of the middle axis common to the refiner elements, i.e. the entire refining area. On the other hand, it is also possible to feed different amounts of material to be refined to different feed regions via different feed channels. Such a solution can be used, for instance, when the refined material is desired to form a mixture consisting of material portions refined in different ways, in which case the refining surfaces of the stator and rotor of the refiner at different feed regions of the refiner can be provided in such a manner that they achieve different refining results.

In the embodiment of FIG. 2, the space inside the rotor 3 is divided by the partition wall structures 17 into separate feed regions 18 and corresponding feed channels 19 in a cylindrical refiner but a corresponding solution may also be used in cone refiners. In the embodiment of FIG. 2, the refiner rotor is arranged inside the refiner stator but the solution can also be implemented so that the refiner stator is arranged inside the refiner rotor, in which case the stator forms the first refiner element of the refiner and the rotor forms the second refiner element of the refiner. Furthermore, the solution of FIG. 1 resembles the solution of FIG. 2 in that the support structure 14 in FIG. 1 forms a sort of partition wall structure for dividing the space inside the rotor into two parts, i.e. feed regions.

In the embodiments of FIGS. 1 and 2, material to be refined is arranged to be fed from both ends of the rotor of the refiner. However, the same solution may also be used in the refiner stator instead of the rotor, in which case the refiner stator may be formed according to the examples described above in connection with the rotor. Furthermore, the inner structure of the rotor or the stator may comprise partition wall structures 17 or other similar structures for forming feed regions 18 or feed channels 19 also when the feed of material to be refined only takes place at one end of the rotor or the stator. The feed of material to be refined into the refiner element may also be arranged to take place at both ends of the refiner element also when the refiner does not comprise special feed regions in the direction of the middle axis of the refiner elements and separated with a wall. In this case, too, material to be refined may be guided mainly to two different feed regions in the direction of the middle axis of the refiner shaft or the refiner elements, and flows to such feed regions may be controlled by controlling the feed flows. To clarify the division into regions, the feed space may be provided with walls partially separating the space, or flow guides guiding flows to a desired feed region may be provided.

Figure 3:
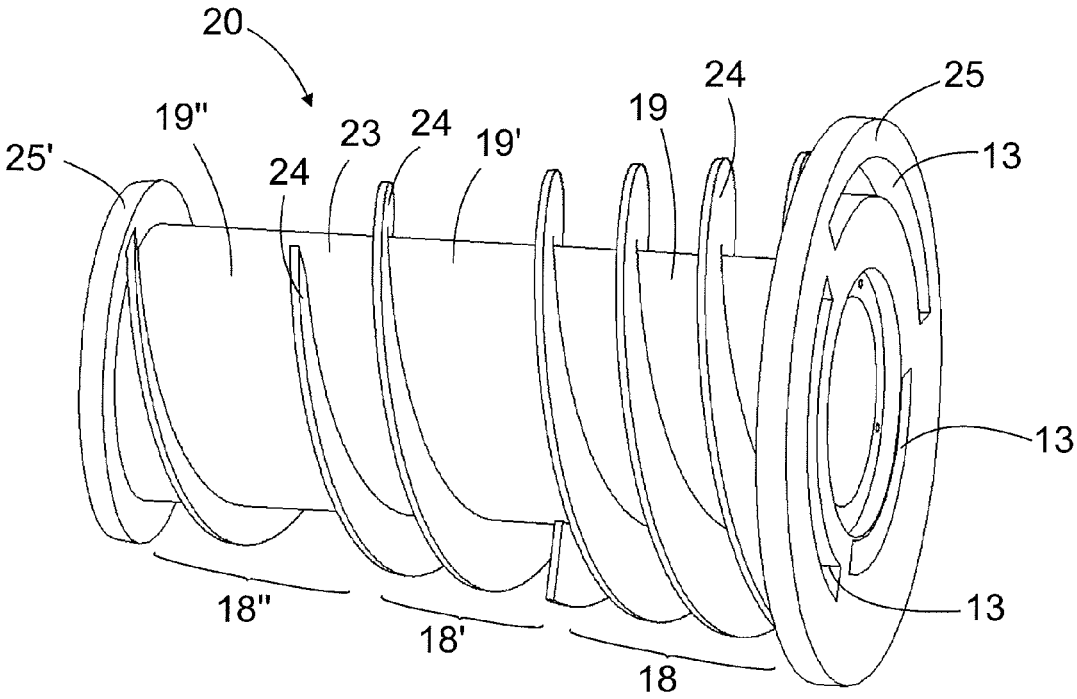
FIG. 3 schematically shows a feed frame used in a cone refiner.
Figure 4:
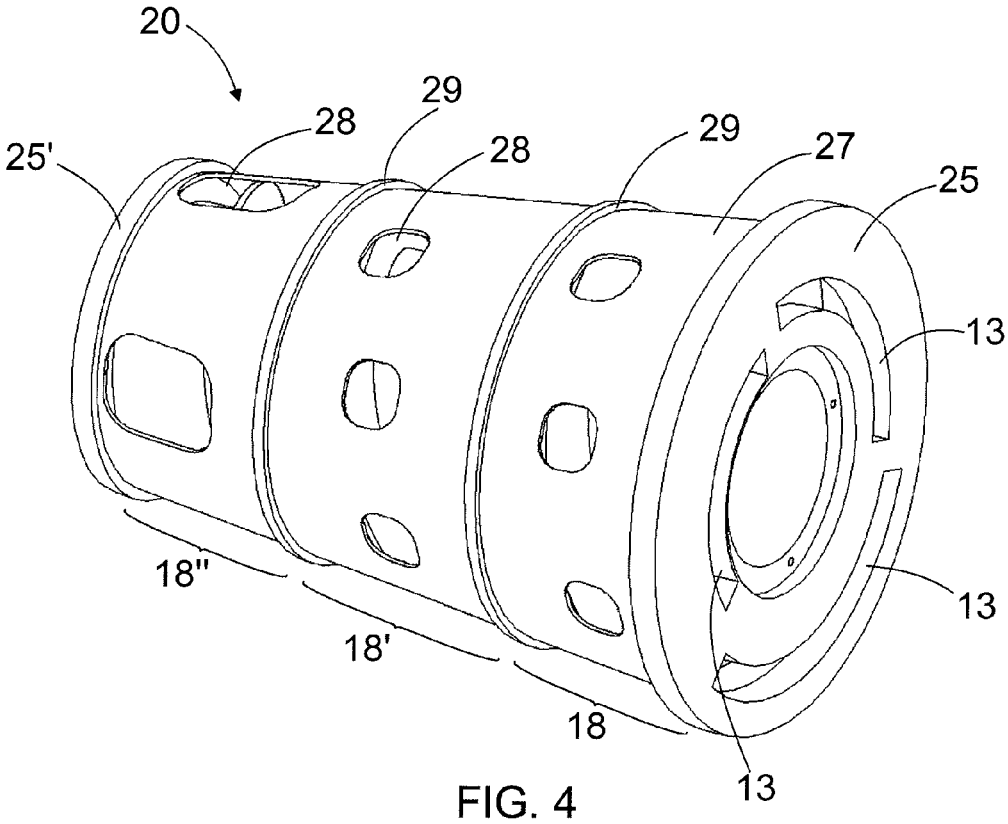
FIG. 4 schematically shows a second feed frame used in a cone refiner.
Figure 5:
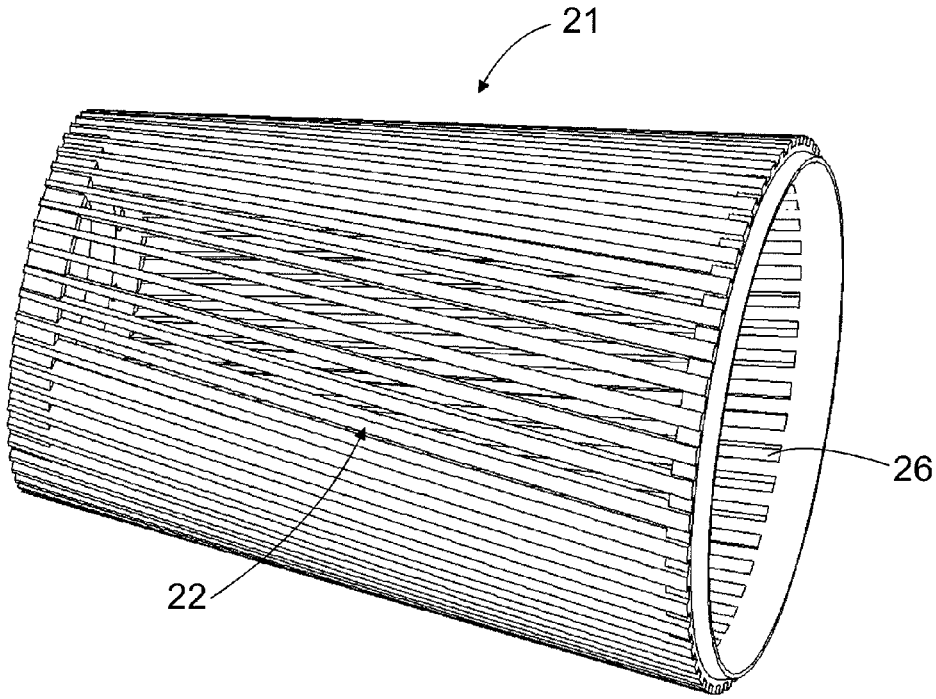
FIG. 5 schematically shows a refiner element that can be arranged at the feed frame of FIG. 3 or 4.

FIG. 3 schematically shows a feed frame 20, which may be used for feeding material to be refined in a cone refiner, so that the material to be refined may be fed in the direction of the middle axis of the refiner elements as feed flows differing from one another through the refining surface of the refiner element into the refining space. FIG. 4 schematically shows a second feed frame 20, which may be used for feeding material to be refined in a cone refiner, so that the material to be refined may be fed in the direction of the middle axis of the refiner elements as separate feed flows differing from one another through the refining surface of the refiner element into the refining space. FIG. 5 schematically shows a refiner element 21 provided with a refining surface 22, which may be used in connection with the feed frame 20 according to FIG. 3 or 4. The refiner element 21 of FIG. 5 comprises openings 26 extending along substantially the entire length of the refiner element 21 and forming openings 26 which extend through the refining surface 22 of the refiner element 21.

In this specification, feed flows differing from one another generally refer to feed of material to be refined in such a manner that, in the area of different feed regions in the direction of the middle axis of the refiner elements, the feed rate, i.e. the flow rate, for material to be refined and fed through the refining surface of the refiner element or the properties of the material to be refined differ from one another. However, material flows to be fed through the refining surface in different feed regions may mix with each other to some extent in the feed regions or on the fringes of different feed regions, before the material flows move through the openings in the refining surface into the refining space. In this specification, feed flows separate from one another generally refer to feed of material to be refined through the openings in the refining surface of the refiner element in the area of different feed regions in the direction of the middle axis of the refiner elements, so that the material flows to be fed through the refining surface in the area of different feed regions cannot mix with one another before the material flows move through the openings in the refining surface into the refining space.

The feed frame 20 of FIG. 3 comprises a frame structure 23 and spiral blades 24 arranged on the outer side of the frame structure 23. By varying the length of the spiral blades 24 and the distance between them, the feed frame of FIG. 3 is provided with three feed channels 19, i.e. feed channels 19, 19' and 19", with different dimensions, where the distance between the blades 24 and the length of the blades 24 differ from each other. The properties of the feed channels 19 may thus be varied by selecting the distance between the blades and the length thereof. The feed channels 19 differing from each other in the longitudinal direction of the feed frame 20 provide three corresponding feed regions 18, 18' and 18".

The feed frame 20 further comprises end pieces 25 and 25', of which the end piece 25 on the right side of FIG. 3 is provided with three feed openings 13, through which separate feed flows for material to be refined may be provided to each corresponding feed channel 19, 19' and 19".

The feed frame 20 of FIG. 3 may be utilized in the refiner 1 in the following manner, for instance. The refiner element 21 of FIG. 5 may be fixed to the feed frame 20, for instance to the end pieces 25 of the feed frame 20, and the feed frame 20 and the refiner element 21 fixed thereto are arranged in the refiner in a rotating manner, in which case the feed frame 20 and the refiner element 21 fixed thereto form the rotor of the refiner, i.e. the rotating refiner element of the refiner. The refiner element of FIG. 5 comprises openings 26, which in this case form the openings in the refining surface of the rotor. The rotor consisting of the feed frame 20 and the refiner element 21 is arranged in the refiner in such a manner that the refiner stator will surround the feed frame 20 and the refiner element 21 therein. In this case, material to be refined is fed through the feed openings 13 in the end piece 25 to each feed channel 19, 19' and 19", and the material to be refined moves in the feed region 18, 18', 18" of the refiner, corresponding to each feed channel 19, 19' and 19", through the openings 26 of the refiner element 21 to the refining space.

The feed frame 20 of FIG. 3 may also be utilized in the refiner 1 by arranging the feed frame 20 rotatably in the refiner and fixedly attaching, for instance, the ends of the refiner element 21 to the refiner frame by means of collars not shown in FIG. 5 for the sake of clarity, whereby the refiner element 20 forms the stator of the refiner. In this case, the refiner is provided with a rotor surrounding the stator, and the stator formed by the refiner element 21 provides the first refiner element of the refiner and the rotor surrounding the refiner element 21 provides the second refiner element of the refiner. As described above, material to be refined is fed through the feed openings 13 in the end piece 25 to each feed channel 19, 19' and 19", and the material to be refined moves in the feed region 18, 18', 18" of the refiner, corresponding to each feed channel 19, 19' and 19", through the openings 26 of the refiner element 21 to the refining space.

The feed openings 13 are disposed at different distances in the radial direction of the end piece 25, which makes it possible to provide a separate feed for material to be refined to each feed channel 19, 19' and 19" also when the feed frame 20 is arranged in the refiner 1 in a rotating manner. The feed of material to be refined into an individual feed opening in the end piece 25 of the rotatably arranged feed frame 20 may be provided, for instance, by means of a feed ring not shown in the figures for the sake of clarity and arranged at a distance in the radial direction of the end piece corresponding to the feed opening, whereby the material to be refined may flow from this feed ring into the feed opening regardless of the position of the feed opening. The feed ring may have three rings for implementing a separate feed to each feed opening 13 of the feed frame 20.

The flow of material to be refined in the feed channels 19, 19' and 19" may be controlled by selecting the relative positions of the spiral blades 24 and the lengths thereof, whereby the relative positions of the spiral blades affect the width of the feed channels, i.e. the distance between the blades in the longitudinal direction of the feed frame, and the length of the spiral blades in the longitudinal direction of the feed frame affects the total length of the feed channel 19 in the longitudinal direction of the feed frame and thus the size of the feed regions 18, 18' and 18" in the longitudinal direction of the feed frame 20. As the feed frame rotates, the spiral blades 24 push the material to be refined both forwards in the feed channel and out of the feed channel 19 through the openings in the refining surface in the area of the feed region 18, 18', 18" corresponding to each feed channel 19, 19', 19". In addition to or instead of changing the distance between the spiral blades or the length thereof, the flow in the feed channels 19, 19' and 19" may be controlled by providing each feed channel 19, 19' and 19" with a feed pressure control for the material to be refined, which can be adjusted according to each channel. In the embodiment of FIG. 3, the properties of the feed channels 19, 19' and 19" concerning the distance and length of the blades differ from one another, but they could naturally also be similar to each other, in which case the properties of material flows fed through the corresponding feed regions 18, 18' and 18" would be similar. In this case, and also in the case of feed channels with differing properties, it is possible that materials with differing fiber materials, such as wood species in the case of paper manufacture, may be fed through different feed channels 19, 19' and 19" and the corresponding feed regions 18, 18' and 18" into the refining space.

In the above embodiments, the feed frame 20 is arranged in the refiner in a rotating manner, but the feed frame 20 may also be arranged fixedly in the refiner. In this case, the refiner element 21 placed immediately around the feed frame may be arranged rotatably with respect to the refiner frame by means of a separate drive, thus forming the rotating refiner element of the refiner. Alternatively, the refiner element 21 placed immediately around the feed frame may be arranged fixedly with respect to the refiner frame, thus forming the fixed refiner element of the refiner.

FIG. 4 schematically shows a second feed frame 20, where the feed frame 20 shown in FIG. 3 is provided with a casing 27. The casing 27 comprises openings 28, through which the material to be refined may be fed via the feed channels 19, 19' and 19" formed by the spiral blades 24 in desired sections in the direction of the middle axis of the refiner elements of the refiner. The embodiment of FIG. 4 shows a possibility where the openings 28 in the longitudinal direction of the feed frame 20 may have different sizes in the different feed regions, but the openings 28 may naturally also have the same size. FIG. 4 also shows collars 29 arranged on the casing 27, which may be used for supporting the refiner element 21 of FIG. 5, for example, that is to be arranged on the casing or for controlling the flow of material to be refined to a specific feed region in the direction of the middle axis of the refiner elements.

Figure 6:
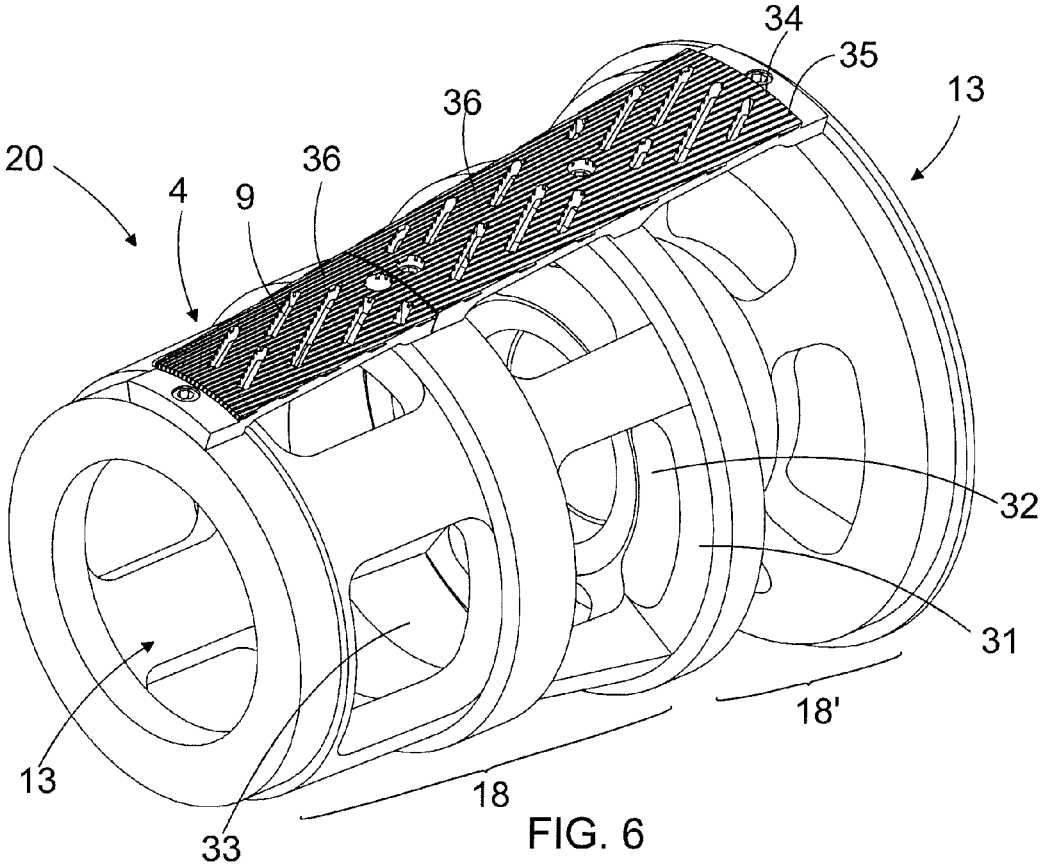
FIG. 6 schematically shows a third feed frame used in a cone refiner.

FIG. 6 schematically shows a third feed frame 20 that can be used in a cone refiner. The feed frame 20 of FIG. 6 has feed openings 13 at its ends for feeding material to be refined into the feed frame 20. The space inside the feed frame 20 further encompasses a flange structure 31, which may serve as a support structure or partition wall structure for the feed frame 20 and which comprises openings 32, said flange structure 31 dividing the internal space of the feed frame 20 into two sections partly separated from one another. Due to the openings 32, the pressure difference between the inner sections of the feed frame 20 on both sides of the flange structure 31 may stabilize. Because of said flange structure 31, the feed frame 20 is provided with two feed regions, i.e. feed regions 18 and 18', in the direction of the middle axis of the feed frame 20, whereby a third of the cone length on the side of the larger end of the cone structure forms the feed region 18' and the rest forms the feed region 18. The feed frame 20 further comprises openings 33, through which the material to be refined may move from the internal volume of the feed frame 20 to its external volume in the feed regions 18 and 18'. Another possible embodiment in connection with the feed frame 20 of FIG. 6 is one in which the flange structure 31 does not comprise openings 32 and the internal volume of the feed frame 20 is divided into two entirely separate sections, whereby said feed regions 18 and 18' are separate from one another.

Furthermore, blade segments 36 provided with blade bars 34 and blade grooves 35 therebetween are fastened in connection with the feed frame 20 shown in FIG. 6, and the feed frame 20 and the blade segments 36 may together form, for instance, the rotor element for a refiner with a refining surface consisting of blade bars and blade grooves, whereby the feed frame 20 forms the frame structure of the rotor element and the blade segments 36 adjacent to each other form the refining surface 4 for the rotor element. However, the feed frame 20 and the blade segments 36 could also form the stator element of the refiner. For the sake of clarity, FIG. 6 shows only one blade segment in the circumferential direction of the feed frame 20 but it is clear that said blade segments are placed in the region of the entire refining area of the ready-made refiner element. The blade segments 36 further comprise openings 9, via which the material to be refined, moving from the internal volume of the feed frame 20 through the openings in the feed frame 20, may further flow into the refining space of the refiner. Said openings 9 in the blade segments of FIG. 6 are longitudinal and arranged somewhat transversally or at an angle to the direction of travel of the blade bars 34 and blade grooves 35 of the blade segment 36.

In the embodiments shown in connection with FIGS. 3 to 5 and 6, the feed frame 20 is arranged inside the refiner elements of the refiner, but the feed frame may also be arranged outside the refiner elements of the refiner.

The solution of FIGS. 3 to 5 and 6 is applied to a cone refiner but the solution in question can similarly be applied to cylindrical refiners.

FIGS. 3 to 5 further show that the feed channels 19 form three feed regions 18 in the direction of the middle axis of the refiner elements or in the direction of the longitudinal axis of the feed frame 20, but there may be two feed regions 18, as in FIG. 6, for example, or there may be a plurality of feed regions.

In the examples according to FIGS. 1, 2 and 4, the feed regions 18, 18', 18", 18''' are annular regions arranged at the rotor or the stator and formed on the opposite side of the refining surface of the refiner element. All these feed regions 18, 18', 18", 18''' form together a feed surface area which corresponds to preferably at least 60% of the refining area, more preferably 80% of the refining area, and most preferably the entire refining area. The feed region 18, 18', 18", 18''' of the refiner is located preferably at the refining area of the refiner, in which case the material to be refined may flow from the feed regions into the refining space directly through the openings in the wall or refining surface of the refiner element. The feed region is preferably annular, which produces a uniform homogeneous flow space in the feed region or the feed space as a result of centrifugal force, providing a steady flow from the feed region into the refining space and to the entire refining area. The same also applies to the embodiment of FIG. 6.

In the example shown in FIG. 3, the feed regions resemble annular regions arranged at the rotor or the stator and formed on the opposite side of the refining surface of the refiner element. All feed regions 18, 18', 18", 18''' form together a feed surface area which corresponds to preferably at least 60% of the refining area, more preferably 80% of the refining area, and most preferably the entire refining area. The feed region 18, 18', 18", 18''' of the refiner is located preferably at the refining area of the refiner, in which case the material to be refined may flow from the feed regions into the refining space directly through the openings in the wall or refining surface of the refiner element. The feed region is preferably annular, which produces a uniform homogeneous flow space in the feed region or the feed space as a result of centrifugal force, providing a steady flow from the feed region into the refining space. In this example, the flows of different feed regions may mix with one another considerably. However, it is also possible in this case to form three distinctly different feed regions, which may have an effect on, for instance, the volume flow of material to be refined, moving through each feed region into the refining space. If desired, it is possible to advance the separation of the feed regions by covering longer spiral channels along a desired length so that, for instance, the spiral channel 19' opens at the feed region 18' and the spiral channel 19" opens at the feed region 18". The cover or other similar element or part covering the spiral channel may be set at a desired height of the spiral channel or on its outer circumference.

The solution allows to conveniently provide a larger volume flow of material to be refined in the refining area at the larger end of the cone of the cone refiner, where the refining surface area is larger than the corresponding section of the refining area at the smaller end of the cone, than in the refining area at the smaller end of the cone. As a result, the use of the refiner is efficient, which makes it possible to achieve a high refiner capacity and a uniform quality of refined stock. On the other hand, an efficient refiner also means lower energy consumption because the idle operation diminishes.

In the cylindrical refiner, the solution produces the same volume flow to be refined in corresponding sections of the cone length. As a result, the use of the refiner is efficient, which makes it possible to achieve a high refiner capacity and a uniform quality of refined stock.

The annular feed regions may also comprise an axial wall or a plurality of axial walls, which, if desired, prevent or limit possible circular rotation of the material in the area of the feed region. Such walls may also have a circumferential dimension, which means that the feed regions guide the flow to a restricted section of the length or circle of the entire circumference on the diameter of the annular feed region.

The feed of material to be refined to the feed regions according to or similar to FIGS. 1 to 4 and 6 may also be implemented in other ways than described above, such as via a multitubular system or other channel system. It is also possible to feed the material to be refined into the rotor or stator as one feed flow, which is divided into two or more flows to at least two feed regions inside the rotor or the stator. In this case, and in connection with the embodiments of FIGS. 1 to 4 and 6, a method may be employed in the refiner for feeding fibrous material to be refined into the refiner, the method comprising feeding fibrous material to be refined as at least one feed flow into the rotor or the stator and, further, as at least two flows in at least two feed regions from inside the stator or the rotor into the refining space or towards the refining space.

In some cases, the features described in this application may be used as such, regardless of other features. On the other hand, the features described in this application may also be combined to provide various combinations as necessary.

The drawings and the related description are only intended to illustrate the idea of the invention. The invention may vary in its details within the scope of the claims. In the description of the figures, the refiners are said to have both a fixed refining surface or refiner element and a rotating refining surface or refiner element, but it is feasible that both refining surfaces are rotatable, in which case the refining surfaces may rotate around the middle axis in opposite directions. It is furthermore possible that there are more than one pair of refining surfaces or refiner elements. The refining space may also be a combination of a cylindrical and a conical refining space or comprise a plurality of cylindrical and/or conical refining spaces.

The invention claimed is:

1. A refiner for refining fibrous material, the refiner comprising:

at least one first refiner element having a first refiner surface, portions of the first refiner element defining first openings extending through the first refiner surface;

at least one second refiner element having a second refiner surface, portions of the second refiner element defining second openings extending through the second refiner surface, the second refiner element being arranged around the first refiner element in such a manner that the first refiner element and the second refiner element have a common middle axis;

wherein there is a refining space defined between the first refiner element and the second refiner element and wherein the first refiner element or the second refiner element is arranged to rotate around said middle axis;

wherein the first openings in the first refiner surface and the second openings in the second refiner surface are arranged to allow fibrous material to be refined to be fed into the refining space or to exit the refining space; and a structure selected from the group consisting of: a support structure, a wall structure, a flow guide, a channel, and a channel system, arranged with respect to the first openings or the second openings, and dividing the refiner into at least two feed regions arranged one after another along a direction defined by the middle axis through which fibrous material to be refined is feedable into the refining space at different positions along the middle axis.

2. The refiner of claim 1 wherein the refiner further comprises a feed frame forming feed channels corresponding to the feed regions, wherein the feed frame has feed openings for feeding the material to be refined to the feed channels.

3. The refiner of claim 2 wherein the feed frame comprises spiral blades which form the feed channels.

4. The refiner of claim 2 further comprising a frame, wherein the feed frame is arranged rotatably with respect to the frame of the refiner and wherein the first refiner element with first openings is arranged in connection with the feed frame, such that the feed frame and the first refiner element are mounted for rotation and are arranged to rotate around said middle axis.

5. The refiner of claim 2 wherein the feed frame is provided with a casing surrounding the feed frame and provided with openings.

6. The refiner of claim 1 wherein the first refiner element has an inner circumference and wherein the structure further comprises partition wall structures inside the first refiner element which are arranged to divide the space inside the first refiner element, at least on the inner circumference of the refiner element in the direction of the middle axis, into separate feed regions and respective separate feed channels inside the first refiner element in such a manner that each feed channel is arranged to guide material to be refined to a specific feed region corresponding to the respective feed channel.

7. The refiner of claim 6 wherein the first refiner element has two ends viewed in the direction of the middle axis of the first refiner element, and at each of the two ends the first refiner element has portions defining feed openings connecting to the feed channels, for feeding fibrous material to be refined to the feed channels of the first refiner element.

8. The refiner of claim 1 wherein the rotating first refiner element is arranged inside the second refiner element and the second refiner element is fixedly mounted.

9. A refiner for refining fibrous material, the refiner comprising:

a frame;

at least one first conical refiner element mounted for rotation to the frame, the first conical refiner element having a first conical refiner surface, the first conical refiner surface defining a middle axis about which the first conical refiner element rotates, portions of the first conical refiner element defining first openings extending through the first conical refiner element and the first conical refiner surface;

at least one second conical refiner element fixed with respect to the frame having a second conical refiner surface, portions of the second conical refiner element defining second openings extending through the second conical refiner element and the second conical refiner surface, the second conical refiner surface formed about the middle axis, the second conical refiner element positioned with respect to the first conical refiner element in such a manner to define a conical refining space which is formed between the first conical refiner surface and the second conical refiner surface;

wherein the first openings in the first conical refiner surface and the second openings in the second conical refiner surface are arranged to allow fibrous material to be refined to be fed into the refining space or to exit the refining space; and a structure selected from the group consisting of: a support structure, a wall structure, a flow guide, a channel, and a channel system, arranged with respect to the first openings or the second openings, and dividing the refiner into at least two feed regions arranged one after another along a direction defined by the middle axis through which fibrous material to be refined is feedable into the conical refining space at different positions along the middle axis.

10. The refiner of claim 9 wherein the refiner further comprises a feed frame forming feed channels corresponding to the feed regions and wherein the feed frame has feed openings for feeding the material to be refined to the feed channels.

11. The refiner of claim 10 wherein the feed frame comprises spiral blades which form the feed channels.

12. The refiner of claim 10 wherein the feed frame is provided with a casing surrounding the feed frame and provided with openings.

13. The refiner of claim 9 wherein the first conical refiner element has an inner circumference defining an inside space and wherein the structure further comprises partition wall structures inside the first conical refiner element which divide the inside space of the first conical refiner element, at least on the inner circumference of the refiner element in the direction of the middle axis, into separate feed regions and respective separate feed channels inside the first conical refiner element in such a manner that each feed channel is arranged to guide material to be refined to a specific feed region corresponding to the respective feed channel.

14. The refiner of claim 13 wherein the first conical refiner element has two ends along the middle axis of the first conical refiner element, and at each of the two ends the first conical refiner element has portions defining feed openings connecting to the feed channels, for feeding fibrous material to be refined to the feed channels of the first conical refiner element.

15. The refiner of claim 9 wherein the rotating first conical refiner element is arranged inside the second conical refiner element.

* * * * *